US009500391B2

(12) United States Patent
Hope

(10) Patent No.: US 9,500,391 B2
(45) Date of Patent: Nov. 22, 2016

(54) ACTIVE DAMPING VIBRATION CONTROLLER FOR USE WITH CRYOCOOLERS

(71) Applicant: Stephen C. Hope, Bel Air, MD (US)

(72) Inventor: Stephen C. Hope, Bel Air, MD (US)

(73) Assignee: The John Hopkins University, Baltimore, MD (US)

( * ) Notice: Subject to any disclaimer, the term of this patent is extended or adjusted under 35 U.S.C. 154(b) by 808 days.

(21) Appl. No.: 13/874,887

(22) Filed: May 1, 2013

(65) Prior Publication Data

US 2014/0325999 A1 Nov. 6, 2014

(51) Int. Cl.
*F25B 9/14* (2006.01)
*F25D 19/00* (2006.01)

(52) U.S. Cl.
CPC ..... *F25B 9/14* (2013.01); *F25D 19/006* (2013.01); *F25B 2500/13* (2013.01)

(58) Field of Classification Search
CPC .... F25B 9/14; F25B 2500/13; F25B 19/006; F16F 15/002–15/085; F16F 15/28; F16F 2230/0005; F16F 2230/0011; F16F 2232/08; G05B 13/042; G05B 19/404; G05B 2219/39199
USPC ..... 62/6; 356/336.1; 374/121
See application file for complete search history.

(56) References Cited

U.S. PATENT DOCUMENTS 4,389,849 A * 6/1983 Beggs ..... F02G 1/0435 310/15
5,459,383 A 10/1995 Sidman et al.
5,525,845 A 6/1996 Beale et al.
5,642,008 A 6/1997 McCracken
5,642,088 A 6/1997 Unger
6,131,394 A * 10/2000 Lavietes ..... F04B 39/0027 62/55.5
6,199,381 B1 3/2001 Unger et al.
6,293,184 B1 9/2001 Unger
6,446,336 B1 9/2002 Unger
6,684,637 B2 2/2004 Beale
6,782,700 B1 8/2004 Unger et al.
7,043,835 B2 5/2006 Wiseman et al.
7,266,947 B2 9/2007 Keiter et al.
7,458,143 B2 12/2008 Wiseman et al.
2014/0290282 A1* 10/2014 Kuwajima ..... F25B 9/14 62/55.5

FOREIGN PATENT DOCUMENTS

EP 2020744 A2 2/2009

* cited by examiner

*Primary Examiner* — Frantz Jules
*Assistant Examiner* — Brian King
(74) *Attorney, Agent, or Firm* — Quarles & Brady LLP

(57) ABSTRACT

A cryocooler assembly including a cryocooler housing and a free-piston engine arranged within the housing, an absorber housing and a damper motor arranged within the absorber housing, and a controller housing rigidly coupled between the cryocooler and the active damper such that vibrations may pass through the controller. A controller mounted within the controller housing provides power to the cryocooler and monitors the phase and frequency of the power supplied to the cryocooler. The controller monitors the vibration of the cryocooler assembly and provides a damping signal to the active damper. The damping signal generated by the controller is based at least in part on the phase and frequency of the power supplied to the cryocooler and the monitored vibration of the cryocooler assembly.

24 Claims, 12 Drawing Sheets

ACTIVE DAMPING VIBRATION CONTROLLER FOR USE WITH CRYOCOOLERS

BACKGROUND

The present invention is directed to vibration damping control cryocoolers including free-piston engines. More particularly, the invention is directed to an active damping vibration controller for use with a cryocooler where low-vibration levels are required.

Sunpower® Inc. produces a product line of crycoolers under the trade name Cryo Tel®. The system vibration levels of the Cyro Tel® cryocoolers are greatly influenced by the mass, configuration, and rigidity of the system in which the cryocooler is installed. Sunpower® Inc. provides a passive (reactive) balance absorber that is tuned to mitigate a primary drive frequency of the cryocooler. With generic production tuning, the resultant free-body vibration acceleration of the system is approximately 300-400 milli-g (acceleration). This level of vibration is tolerable in many applications.

When lower levels of vibration are required, Sunpower® Inc. offers three options for further reducing vibration levels. First, in-situ tuning of the primary passive absorber when the cryocooler is mounted in the customer's system allows for addressing and mitigating the effects of the system design on the total system vibration. Second, a harmonic passive absorber or a dual-frequency absorber assembly that includes a first and second harmonic absorber may be installed on the cryocooler resulting in vibration levels of 200 milli-g and lower. Finally, an active (powered) absorber may be attached to the back of the cryocooler. The active damper can be driven by a closed loop driver that reads a vibration signal and provides a drive signal to the absorber to counteract the vibration energy. Vibration levels on the order of 40 milli-g can be achieved. Sunpower does not provided the drive system for the active damper.

Infrared (IR) and photo detectors potentially benefit from operation under cryogenic conditions. However, system vibrations can render the use of a cryogenic cooling system undesirable if the vibrations produce more noise for the detectors than the system inhibits. Other detector and sensor types benefit from the invention.

U.S. Pat. Nos. 7,458,143; 7,266,947; 7,043,835; 6,782,700; 6,684,637; 6,446,336; 6,293,184; 6,199,381; 5,642,088; 5,642,008; and 5,525,845 are assigned to Sunpower Inc. and directed to aspects of the Cryo Tel® line of cryocoolers. All the above listed documents are incorporated by reference herein in their entirety.

BRIEF SUMMARY OF THE INVENTION

The present invention overcomes the aforementioned drawbacks by providing a controller that monitors the vibrational output of a cryocooler and communicates a tuned signal to an active damper to reduce the vibrational output of the overall system.

In one construction, the invention provides a controller for a cryocooler assembly including a cryocooler having a cryocooler housing, a free-piston motor positioned within the housing, and a cold head, and an active damper coupled to the cryocooler and arranged to control vibrations of the cryocooler assembly. The controller includes a wall that is rigidly coupled between the cryocooler and the active damper such that the vibration passes between the cryocooler, the controller, and the active damper. A power supply connector receives power, a cryocooler power connector is arranged to provide power to the cryocooler, a damping connector is arranged to provide power to the active damper, and a control connector receives signals indicative of system vibrations from a vibration detector. The controller monitors the phase and frequency of the power supplied to the cryocooler, the system vibrations, and sends a damping signal to the active damper to control the system vibrations. The damping signal is dependant on at least the monitored system vibrations and the monitored phase and frequency.

In another construction, the invention provides a cryocooler assembly that includes a cryocooler that has a cryocooler housing, a free-piston engine arranged within the housing, and a cold head, an active damper that has an absorber housing and a damper motor arranged within the absorber housing, and a controller that has a controller housing rigidly coupled between the cryocooler and the active damper such that vibrations may pass through the controller. The controller provides power to the cryocooler and monitors the phase and frequency of the power supplied to the cryocooler. The controller further monitors the vibration of the cryocooler assembly, and provides a damping signal to the active damper. The damping signal is generated by the controller based at least in part on the phase and frequency of the power supplied to the cryocooler and the monitored vibration of the cryocooler assembly.

In another construction, the invention provides a controller for a cryocooler assembly that includes a cryocooler and an active damper coupled to the cryocooler and arranged to control vibrations of the cryocooler assembly. The controller includes a controller housing that is configured to be rigidly coupled between the cryocooler and the active damper to transmit vibrations from at least one of the cryocoller and the active damper to the controller. A controller is located within the controller housing and is configured to monitor at least one of a phase and frequency of power supplied to the cryocooler, monitor vibration received through the controller housing from at least one of the cryocooler assembly and the active damper, and generate a damping signal based at least in part on the at least one of the phase and frequency of the power supplied to the cryocooler and the monitored vibration. The damping signal configured to be communicated to the active damper to control future vibrations.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

Figure 1:
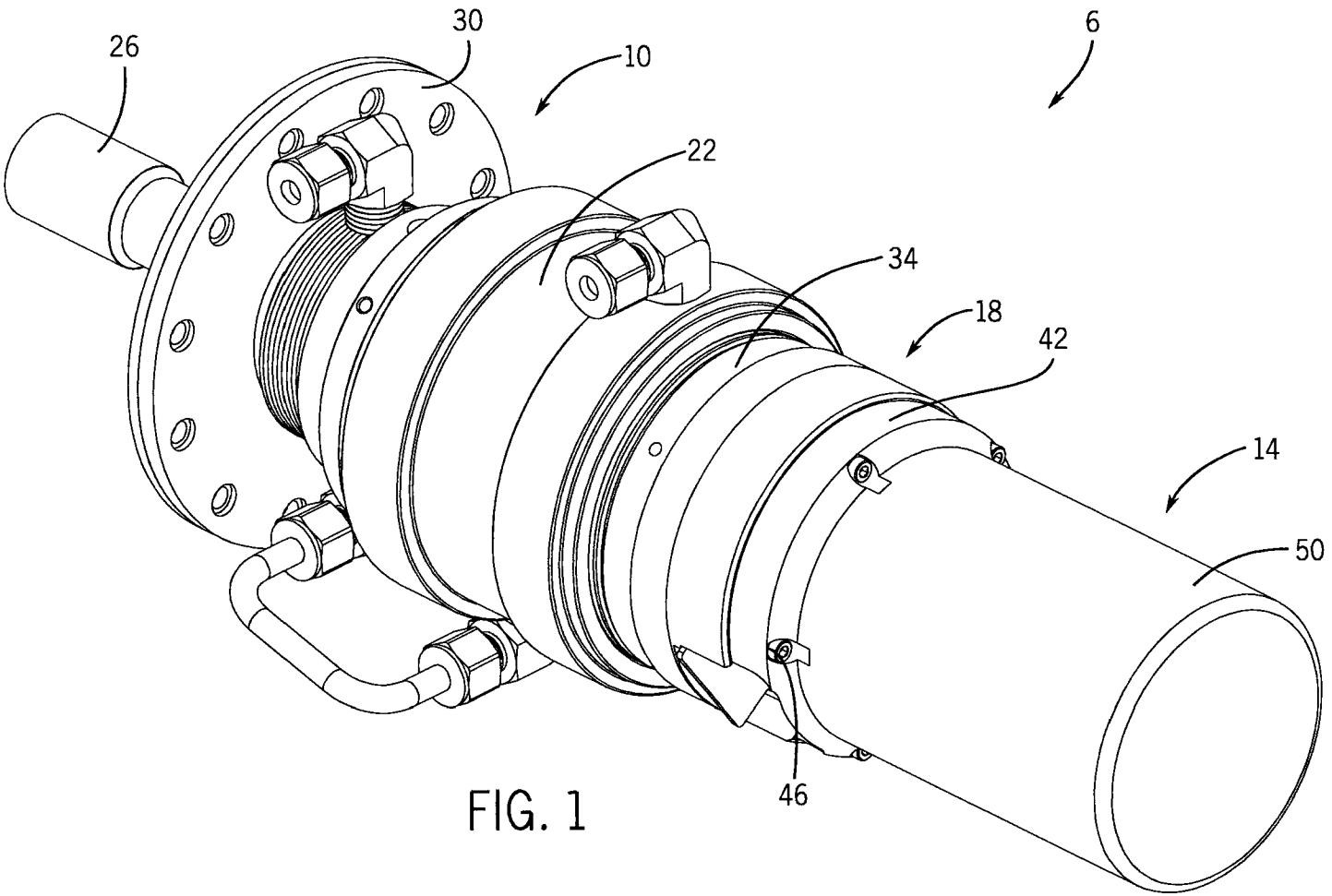
FIG. 1 is a perspective view of a cryocooler assembly according to one embodiment of the invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

The present invention will be described in terms of one or more embodiments, and it should be appreciated that many equivalents, alternatives, variations, and modifications, aside from those expressly stated, are possible and within the scope of the invention.

Figure 2:
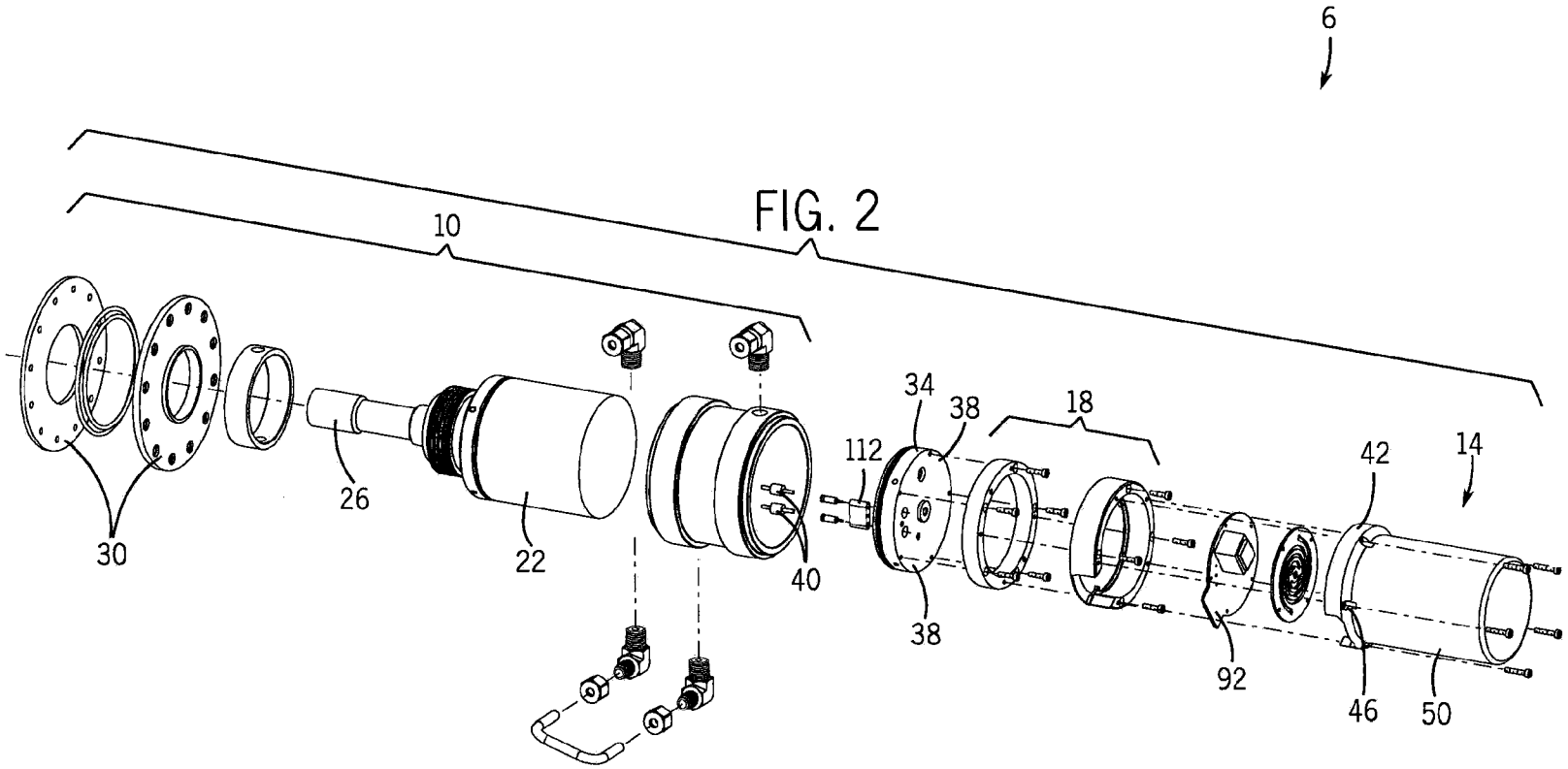
FIG. 2 is a perspective exploded view of the cryocooler assembly of FIG. 1.
Figure 3:
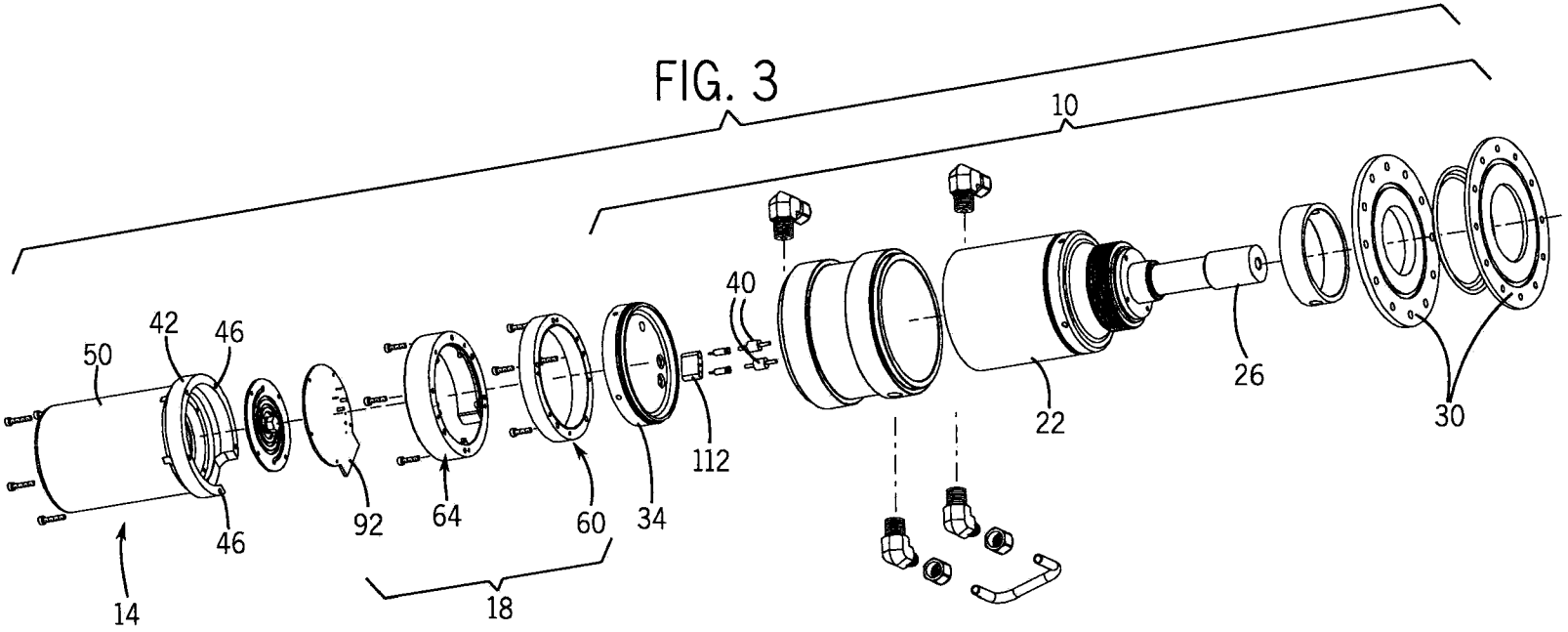
FIG. 3 is a perspective exploded view of the cryocooler assembly of FIG. 1.
Figure 4:
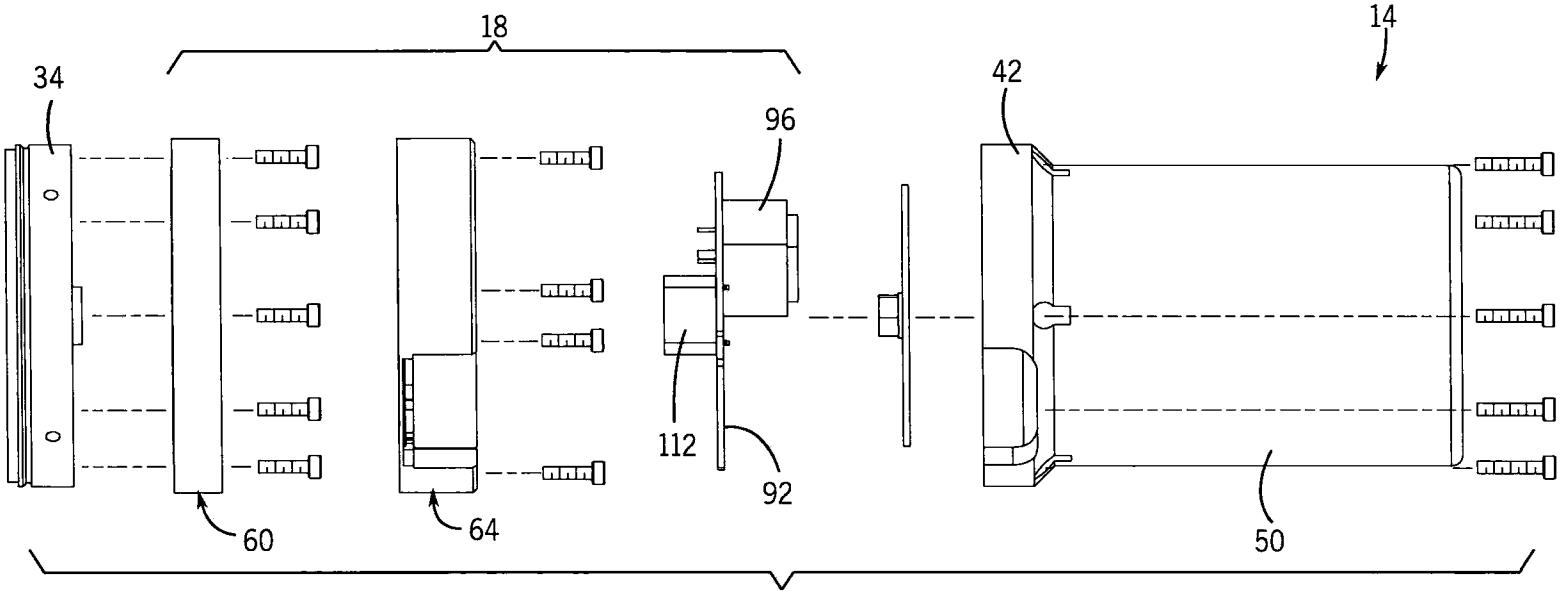
FIG. 4 is a front exploded view of a portion of the cryocooler assembly of FIG. 1.
Figure 5:
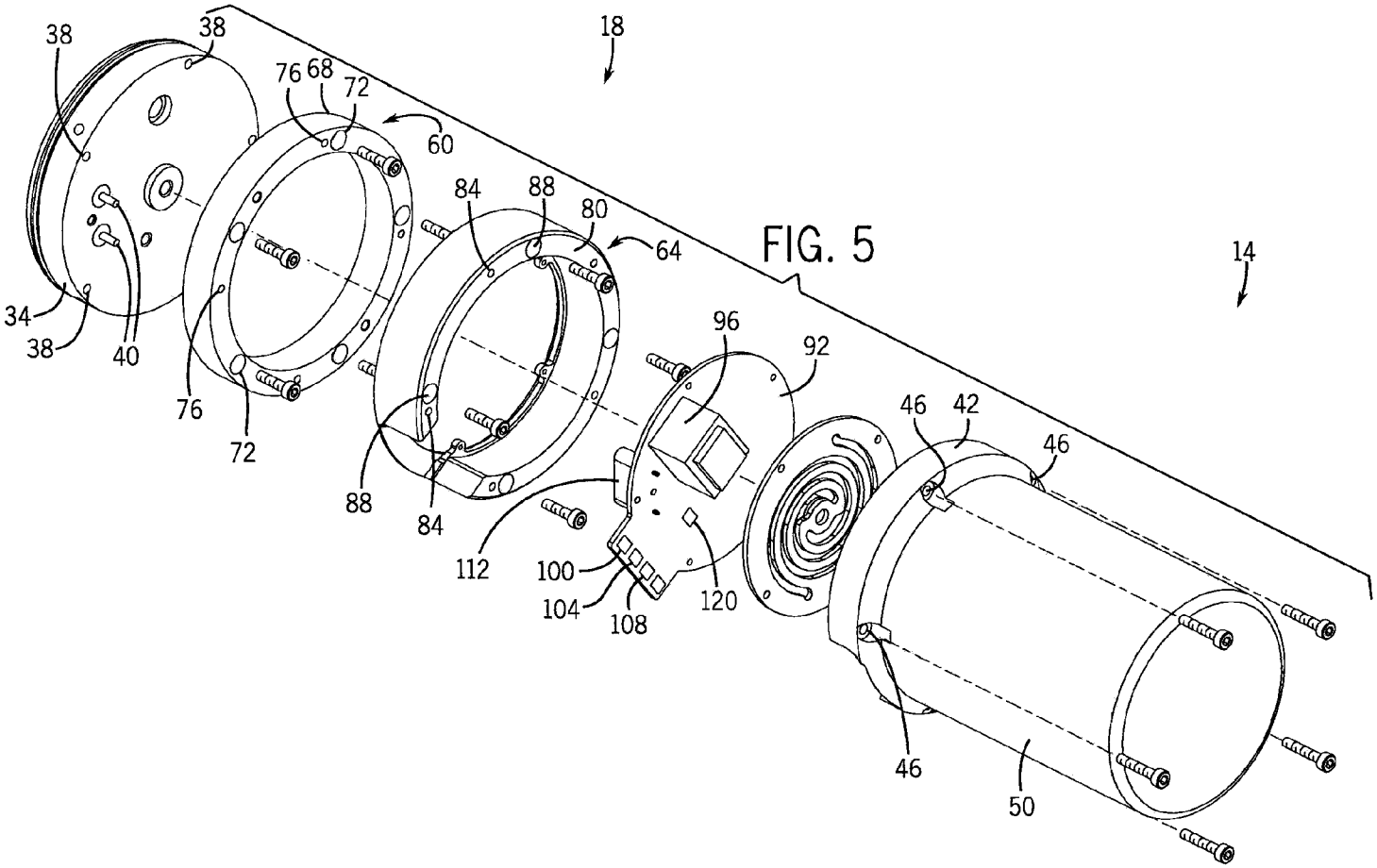
FIG. 5 is a perspective exploded view of the portion of the cryocooler assembly of FIG. 4.
Figure 6:
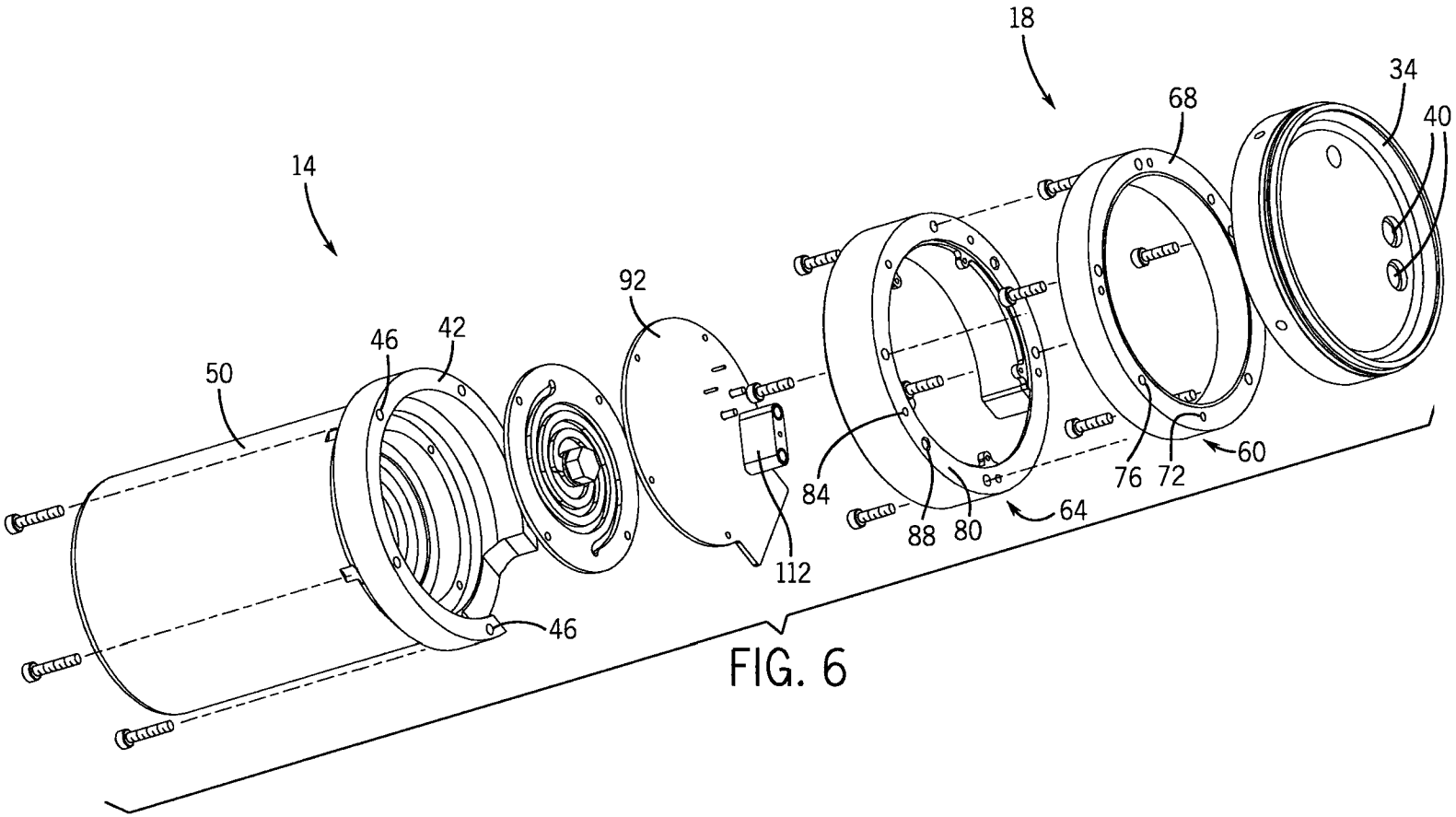
FIG. 6 is another perspective exploded view of the portion of the cryocooler assembly of FIG. 4.
Figure 7:
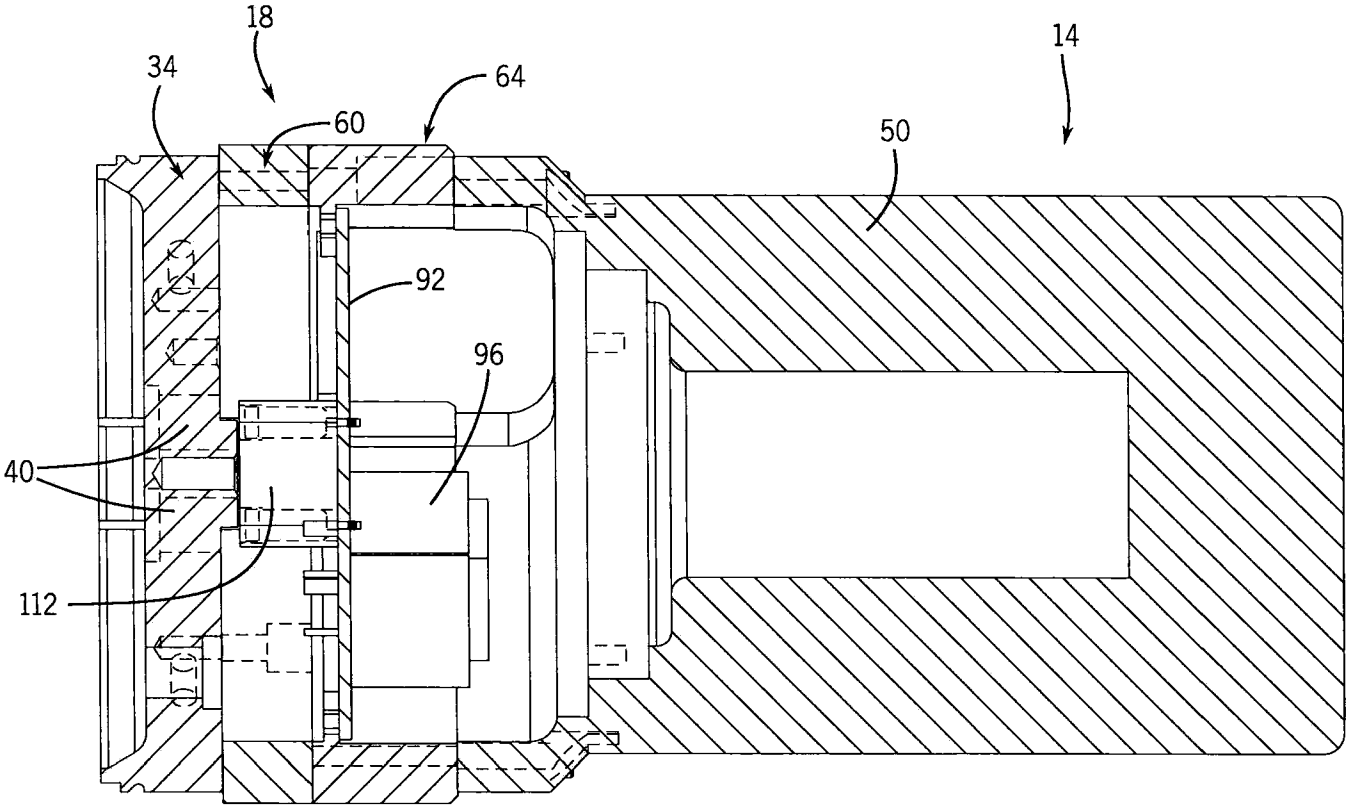
FIG. 7 is a sectional view of the portion of the cryocooler assembly of FIG. 4.

FIGS. 1-3 show a cryocooler assembly 6 that includes a free-piston type cryocooler 10. For example, a Cryo Tel® brand cryocooler is an example of one cryocooler that may be used with the present invention. The cryocooler assembly 6 also includes an active damper motor in the form of an active absorber or damper 14. One example, of an active damper 14 is offered by Sunpower® Inc. The cryocooler assembly 6 further includes a controller in the form of an active damping vibration controller 18.

The cryocooler 10 includes a piston body 22 that houses a motor, a piston, and other components of the cryocooler 10, as is understood in the art. The cryocooler 10 further includes a cold head 26 that acts as an interface for heat exchange with whatever system the cryocooler 10 is used with. Details of the function and internal components of the cryocooler 10 are well known and, as such, will not be discussed herein.

The cryocooler 10 includes a mounting plate 30 arranged to mount the cryocooler 10 to an installation (e.g., IR detector system), as desired. The piston body 22 includes a rear wall or plate 34 that defines mounting holes 38 (see FIG. 2) and power leads in the form of passthroughs 40. The rear plate 34 is rigidly mounted to the piston body 22 or formed as a part thereof The passthroughs 40 are arranged to communicate power to the cryocooler 10.

Figure 8:
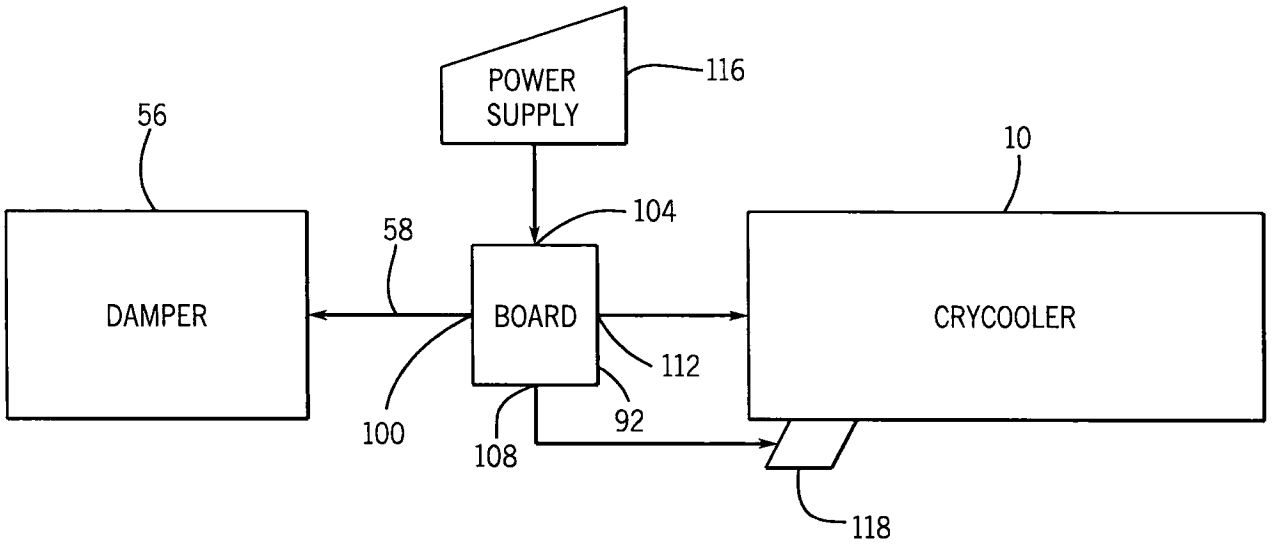
FIG. 8 is a schematic representation of a control system used with the cryocooler of FIG. 1.
Figure 9:
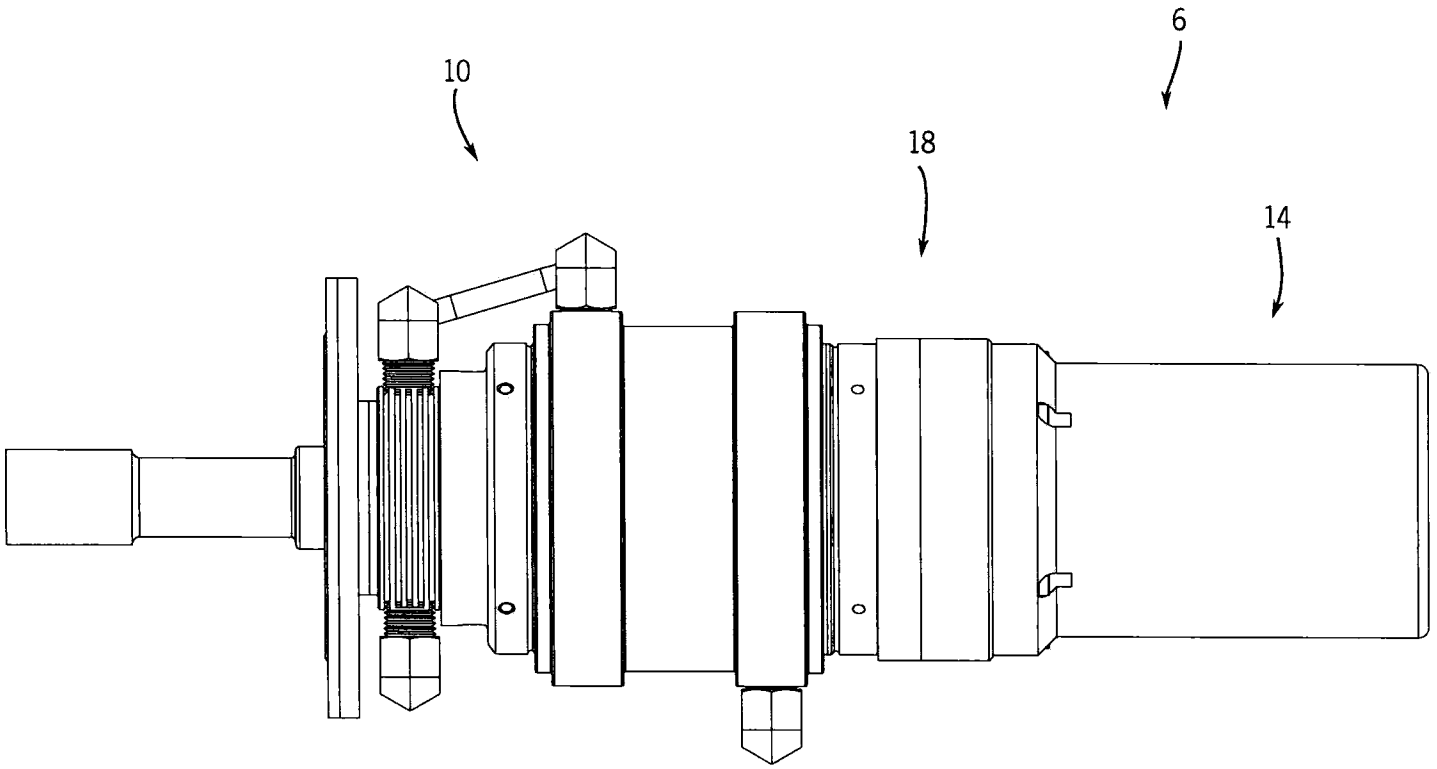
FIG. 9 is a front view of the cryocooler assembly of FIG. 1.
Figure 10:
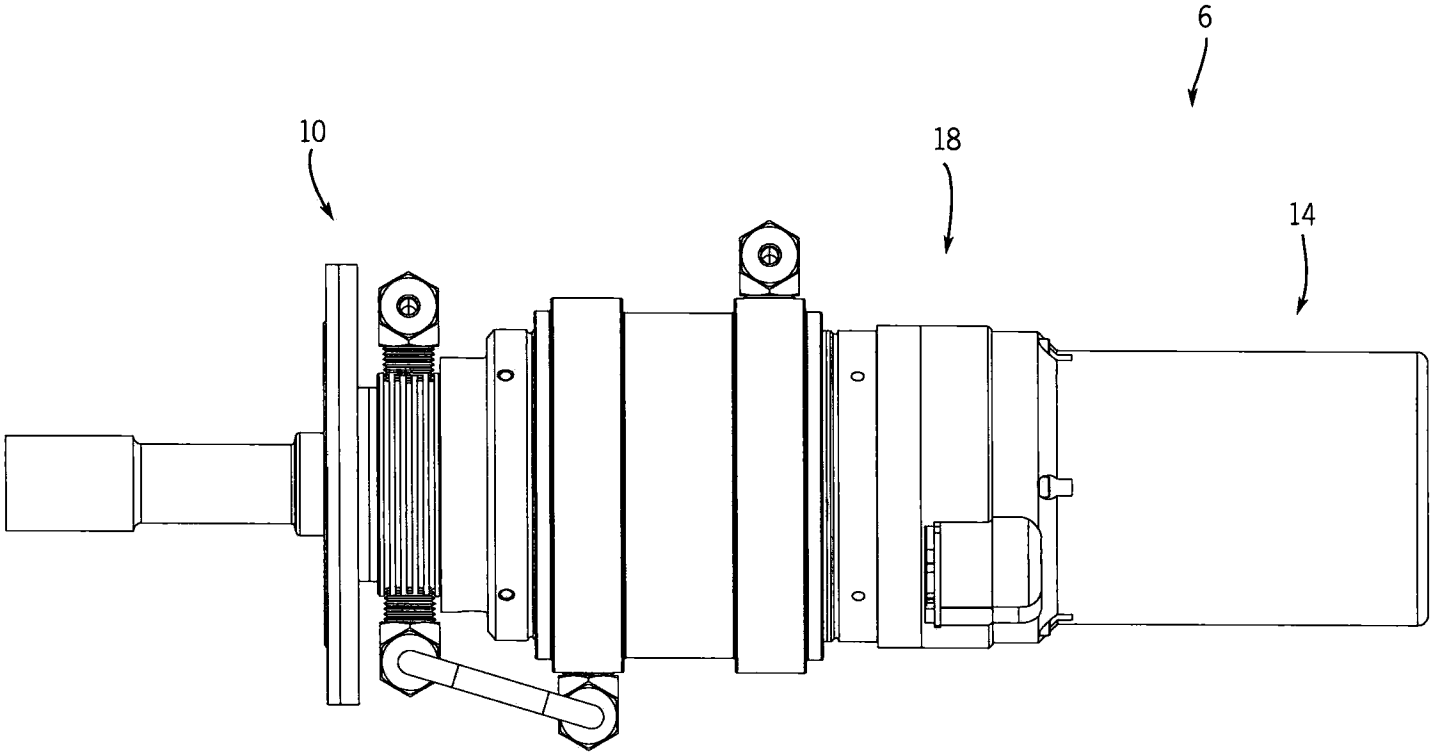
FIG. 10 is a back view of the cryocooler assembly of FIG. 1.
Figure 11:
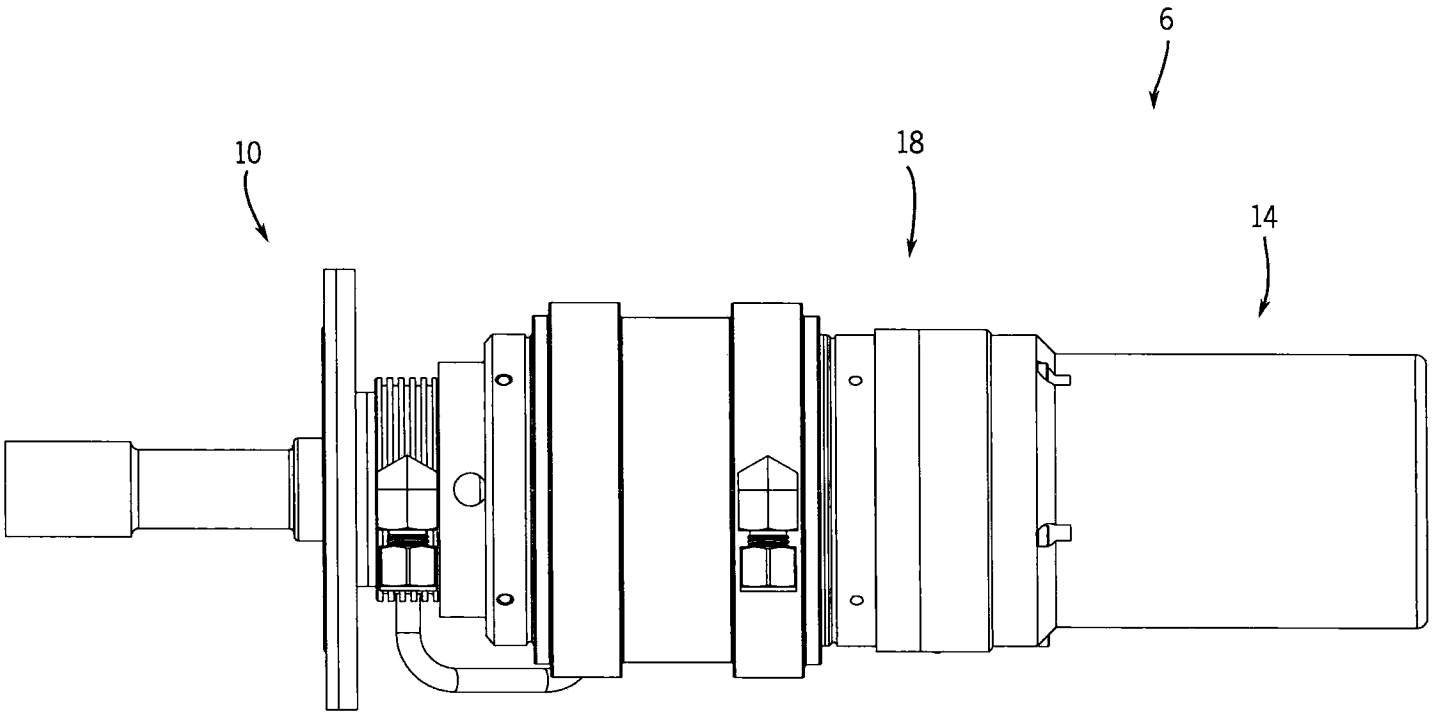
FIG. 11 is a top view of the cryocooler assembly of FIG. 1.
Figure 12:
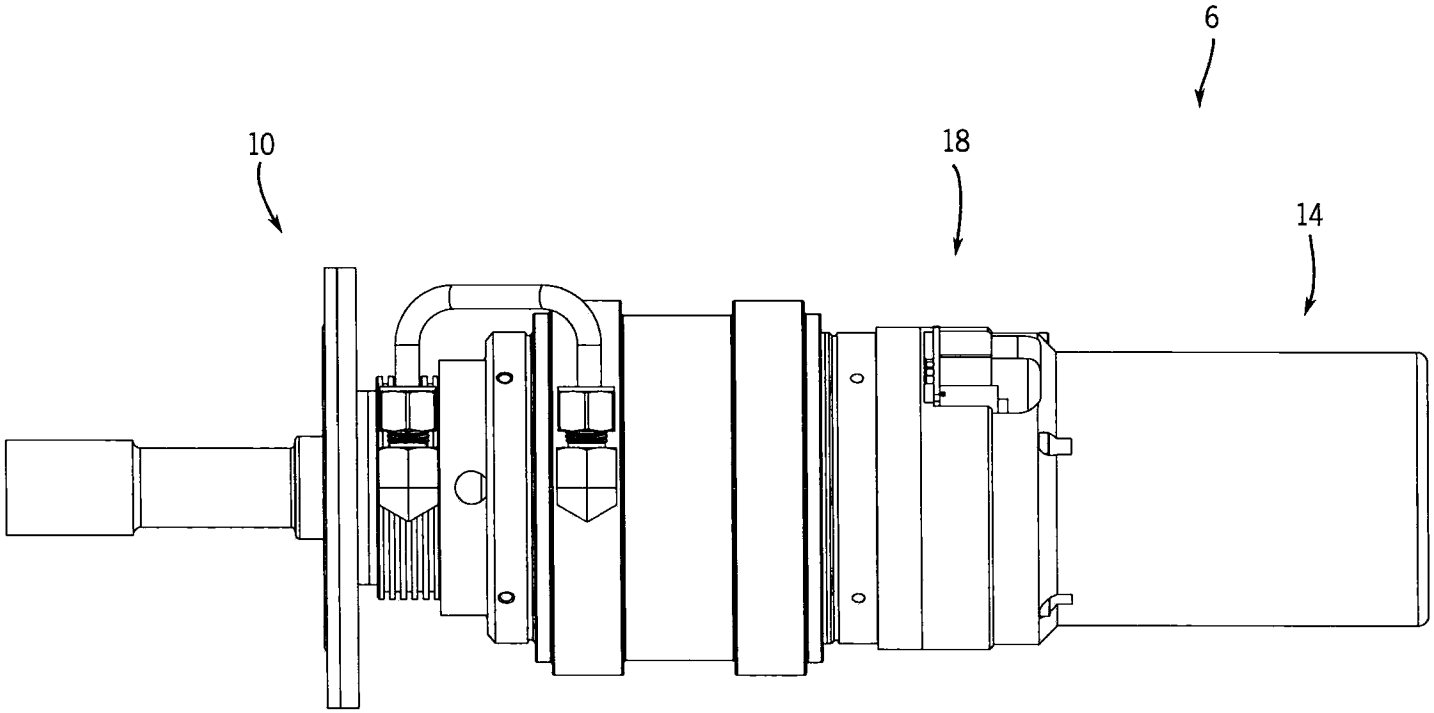
FIG. 12 is a bottom view of the cryocooler assembly of FIG. 1.

The active damper 14 includes a mounting plate 42 with mounting holes 46 arranged to align with the mounting holes 38 of the piston body 22, and a damper motor housing 50. A damper motor 56 (see FIG. 8) is mounted within the damper motor housing 50 and arranged to affect the vibration of the cryocooler 10 through the mounting plate 42 and receives power through damper power leads 58 (represented in FIG. 8).

With reference to FIGS. 4-7, the controller 18 includes a housing in the form of an adapter ring 60 and a main ring 64. The adapter ring 60 includes a rigid sidewall 68 that defines a hole pattern 72 arranged for coupling the adapter ring 60 to the mounting holes 38 of the cryocooler 10 and a hole pattern 76 arranged for coupling to the main ring 64. The illustrated sidewall 68 is a quarter inch thick aluminum sidewall. In other embodiments, the sidewall may be formed of other material and be of a sufficient thickness to provide rigidity and effective transfer of vibrations therethrough. The adapter ring 64 defines a substantially open central cavity.

The main ring 64 includes a rigid sidewall 80 that defines a hole pattern 84 arranged for coupling the main ring 64 to the mounting holes 46 of the active damper 14 and a hole pattern 88 arranged for coupling to the adapter ring 60. The sidewall 80 may be a quarter inch thick aluminum sidewall. In other embodiments, the sidewall may be formed of other material and be of a sufficient thickness to provide rigidity and effective transfer of vibrations therethrough.

A printed circuit board 92 is mounted within the main ring 64 and includes an on-board controller 96, a damping output 100, a power supply connector 104, a control connector 108, and a cryocooler power connector 112. The on-board controller 96 monitors the phase and frequency of the power supplied from a power supply 116 to the power supply connector 104 and passed to the cryocooler power connector 112, provides a power output to the damping output 100, and relays data to the control connector 108.

The damping output 100 is connected to the active damper 14 such that the damper motor 56 is operated in response to the output relayed form the on-board controller 96 through the damping output 100.

The control connector 108 is connected to a computer, data logging device, or external control device as desired to monitor or control the operation of the controller 18. A sensor or vibration detector 118 (see FIG. 8) is also connected to the control connector 108 either directly or through a network. The illustrated vibration detector 118 is a MEMS 3 axis accelerometer, though standard accelerometers or other detector types may be used. The vibration detector 118 is positioned to detect the vibration level transferred from the cryocooler assembly 6 to the installation and may be positioned on the printed circuit board 92, on the cryocooler 10, or in another location, as desired. In the illustrated embodiment, the control connector 108 is a USB port arranged to be connected to a computer. In other constructions, the control connector 108 may be an Ethernet port or another connection type (e.g., RS232, RS485, MODBUS, CANBUS, LonWorks, Wi-Fi, Bluetooth).

The illustrated cryocooler connector 112 includes an on-board clamp in the form of a socket that is arranged to engage the passthoughs 40 of the piston body 22 for providing power to the cryocooler 10. Alternatively, the cryocooler connector 112 may include an external port.

In one construction of the invention, the controller 18 includes an on-board damping motor 120 (see FIG. 5) that responds to activation by the on-board controller 96 to mitigate vibration and noise of the printed circuit board 92 itself. In some constructions, the on-board damping motor 120 may be removed.

To assemble the cryocooler assembly 6, the cryocooler 10 is mounted to the installation with the mounting plate 30. The adapter ring 60 of the controller 18 is then rigidly fastened to the rear plate 34 of the piston body with fasteners engaging the hole pattern 72 of the adapter ring 60 and the mounting holes 38 of the rear plate 34.

The main ring 64 of the controller 18 is then aligned with the adapter ring 60 and the passthroughs 40 are aligned with the cryocooler connector 112. The cryocooler connector 112 engages the passthroughs 40 and the main ring 64 is rigidly fastened to the adapter ring 60 by engaging fasteners with the hole pattern 88 of the main ring 64 and the hole pattern 76 of the adapter ring 60. The controller 18 is then rigidly fastened to the cryocooler 10 such that vibrations are effectively translated therebetween.

The active damper 14 is then fastened to the controller 18 by engaging fasteners with the mounting holes 46 of the active damper 14 with the hole pattern 84 of the main ring 64. The cryocooler 10, the active damper 14, and the controller 18 then form a rigid body through which vibration may readily pass. In some constructions, passive dampers may be employed in addition to the active damper 14, as desired.

Once physically assembled, power is connected from the power supply 116 to the power supply connector 104 for powering the cryocooler assembly 6. An external cable is routed from the damping output 100 to the active damper 14, an external cable is routed from the control connector 108 to the computer, and the vibration detector 118 is connected either through a network or directly to the control connector 108. Once assembled and connected, the cryocooler assembly 6 may be operated.

In operation, power passes from the power supply 116 to the power supply connector 104 on the controller 18. The controller 18 monitors the phase, amplitude, and frequency of the power that is subsequently supplied to the cryocooler 10. The illustrated controller 18 utilizes a current transformer. Other constructions include but are not limited to voltage measurement, either direct or across a current sense resistor, or Hall Effect current sensing.

The controller 18 also monitors the vibration of the cryocooler assembly 6 with the vibration detector 118. The illustrated embodiment utilizes a programmable bandpass filter and peak detector. Other constructions include fixed filters with peak or root mean square (RMS) detectors, or analysis in the digital domain using techniques such as Fast Fourier Transforms (FFT).

The on-board controller 96 then conducts a tuning operation wherein a damping signal is generated based on the detected vibrations and sent to the active damper 14 to counter and mitigate the vibrations. The illustrated damping signal is a complex waveform generated by summing harmonics. Other constructions for generating the damping signal include, but are not limited to error signal inversions.

The damping signal is then provided to the active damper 14 to power the damper motor. The illustrated embodiment utilizes an H-Bridge pulse with modulator. Other constructions include but are not limited to an analog amplifier, a servo drive, or an inverter.

Because the controller 18 is monitoring the phase, amplitude, and frequency of the power supplied to the cryocooler 10 and the resultant vibration, a feedback or feedforward loop may be used to generate damping signals that are in-phase and in-frequency with the power signal sent to the cryocooler 10 such that a large number of harmonics may be tuned and the resultant vibrations may be reduced significantly. For example, five harmonic levels of the 60 Hz signal may be tuned to achieve a minimized vibration level. In other words, the damping signal is phase/frequency locked to the power signal sent to the cryocooler 10.

Further, the damping signal is tuned to harmonics of the fundamental frequency of vibration of the cryocooler assembly 6. For example, the damping signal may be tuned with the first five harmonics of the fundamental frequency. The phase, frequency, and amplitude of the vibrations of the cryocooler assembly 6 may be monitored and used to tune the system to minimize overall vibration.

The damping signal is not directly driven by the detected vibrations, but is rather calculated based on the entire environment of the cryocooler assembly 6. The controller 18 takes into account the power signal sent to the cryocooler 10, environmental vibrations, tuning vibrations provided by the active damper, and other noise to mitigate the overall vibration produced by the cryocooler assembly 6.

This control arrangement leads to great reduction of vibration and noise produced as compared to current control schemes. For example, while zero milli-g's of vibration is theoretically possible, an upper limit of 10 milli-g's is fully attainable. Further, while tuning through the fifth harmonic, 5 milli-g's are attainable as an upper limit of vibration. Vibration levels under 10 milli-g's allows cryocoolers 10 to be utilized on a large number of projects where before cryocooler's 10 were not an acceptable solution, or no simple arrangement existed to use a cryocooler 10. For example, IR detection requires a very low noise and vibration level. The current invention provides a solution whereby cryocoolers 10 may be utilized to their highest advantage without the drawbacks of current cryocooler technology (i.e., vibration and noise).

The position of the controller 18 between the active damper 14 and the cryocooler 10 allows the controller 18 to monitor the power supplied to the cryocooler 10, the vibration levels, and the damping signal sent to the active damper 14 while transferring vibrations between the two components and providing the end user with an easy to assemble, service, and maintain assembly 6. All electrical connections and cables are connected to a central area (i.e., connectors and ports of the controller 18), providing a clean installation. Additionally, the illustrated controller 18 is relatively small and adds only about one or two inches of extension to the cryocooler assembly 6. The minimal additional length allows the cryocooler assembly 6 to be installed in minimally smaller space than a non-controlled cryocooler that lacks the controller 18.

The cooperation of the adapter ring 60 and the main ring 64 allow for rigid coupling of the assembly 6 together without the use of long fasteners passing from the active damper 14 directly to the cryocooler 10. In other words, the two ring arrangement provides a more rigid and easy to assemble unit.

In other constructions, the connectors and communication ports could utilize wireless technology. For example, Bluetooth may be used.

The present invention has been described in terms of one or more preferred embodiments, and it should be appreciated that many equivalents, alternatives, variations, and modifications, aside from those expressly stated, are possible and within the scope of the invention.

I claim:

1. A controller for a cryocooler assembly including:

a cryocooler having a cryocooler housing, a free-piston motor positioned within the housing, and a cold head, and an active damper coupled to the cryocooler and arranged to control vibrations of the cryocooler assembly, the controller comprising:

a wall rigidly coupled between the cryocooler and the active damper such that the vibration passes between the cryocooler, the controller, and the active damper;

a power supply connector receiving power;

a cryocooler power connector arranged to provide power to the cryocooler;

a damping connector arranged to provide power to the active damper; and a control connector receiving signals indicative of system vibrations from a vibration detector, wherein the controller monitors the phase and frequency of the power supplied to the cryocooler, wherein the controller monitors the system vibrations, and wherein the controller sends a damping signal to the active damper to control the system vibrations, the damping signal dependant on at least the monitored system vibrations and the monitored phase and frequency.

2. The controller of claim 1, wherein the wall includes a hole pattern arranged to engage fasteners for coupling between the cryocooler and the active damper.

3. The controller of claim 1, wherein the controller is the only mechanical connection between the active damper and the cryocooler.

4. The controller of claim 1, wherein the wall includes a first ring fastened to the cryocooler and a second ring fastened to the active damper, the first ring fastened to the second ring.

5. The controller of claim 4, wherein the first ring couples to the cryocooler with a first fastener pattern, the second ring couples to the first ring with a second fastener pattern, and the active damper couples to the second ring with a third fastener pattern.

6. The controller of claim 5, wherein the first fastener pattern and the third fastener pattern are substantially the same.

7. The controller of claim 4, wherein the power supply connector, the cryocooler power connector, the damping connector, and the control connector are mounted on a printed circuit board, the printed circuit board being mounted within the first ring.

8. The controller of claim 1, wherein the power supply connector, the cryocooler power connector, the damping connector, and the control connector are accessible through the wall.

9. The controller of claim 1, wherein the cryocooler power connector includes a socket arranged to couple to power pins arranged on the cryocooler housing.

10. The controller of claim 9, wherein the cryocooler power connector is mounted on a printed circuit board arranged within the wall.

11. The controller of claim 1, wherein the wall is about one and one-quarter inch long.

12. The controller of claim 1, wherein the controller reduces the system vibration to below ten milli-g's.

13. The controller of claim 1, wherein the controller reduces the system vibration to below five milli-g's.

14. The controller or claim 1, wherein the controller monitors a fundamental frequency of the system vibration.

15. The controller of claim 14, wherein the damping signal is tuned to damp multiple harmonics of the fundamental frequency of the system vibration.

16. A cryocooler assembly comprising:

a cryocooler including a cryocooler housing, a free-piston engine arranged within the housing, and a cold head;

an active damper including an absorber housing and a damper motor arranged within the absorber housing; and a controller including a controller housing rigidly coupled between the cryocooler and the active damper such that vibrations may pass through the controller, wherein the controller provides power to the cryocooler and monitors the phase and frequency of the power supplied to the cryocooler, wherein the controller monitors the vibration of the cryocooler assembly, and wherein the controller provides a damping signal to the active damper, the damping signal generated by the controller based at least in part on the phase and frequency of the power supplied to the cryocooler and the monitored vibration of the cryocooler assembly.

17. The cryocooler assembly of claim 16, wherein the controller further includes:

a power supply connector receiving power from a power supply, a cryocooler power connector arranged to provide power to the cryocooler, a damping connector arranged to provide the damping signal to the active damper, and a control connector receiving signals indicative of the vibrations of the cryocooler assembly from a vibration detector.

18. The cryocooler assembly of claim 16, wherein the damping signal is tuned through a fifth harmonic of the phase and frequency monitored power provided to the cryocooler.

19. The cryocooler assembly of claim 16, wherein the phase of the damping signal is locked to the phase of the power provided to the cryocooler.

20. The cryocooler assembly of claim 16, wherein the controller housing includes a first ring fastened to the cryocooler and a second ring fastened to the active damper, the first ring fastened to the second ring.

21. The cryocooler assembly of claim 16, wherein the cryocooler, the active damper, and the controller are aligned axially.

22. The cryocooler assembly of claim 16, wherein the controller monitors a fundamental frequency of the vibration of the cryocooler assembly.

23. The cryocooler assembly of claim 22, wherein the damping signal is tuned to damp multiple harmonics of the fundamental frequency of vibration of the cryocooler assembly.

24. A controller for a cryocooler assembly including a cryocooler and an active damper coupled to the cryocooler and arranged to control vibrations of the cryocooler assembly, the controller comprising:

a controller housing configured to be rigidly coupled between the cryocooler and the active damper to transmit vibrations from at least one of the cryocooler and the active damper to the controller, a controller located within the controller housing and configured to:

monitor at least one of a phase and frequency of power supplied to the cryocooler, monitor vibration received through the controller housing from at least one of the cryocooler assembly and the active damper, and generate a damping signal based at least in part on the at least one of the phase and frequency of the power supplied to the cryocooler and the monitored vibration, the damping signal configured to be communicated to the active damper to control future vibrations.

* * * * *